US008171647B2

(12) United States Patent
Gullicks et al.

(10) Patent No.: US 8,171,647 B2
(45) Date of Patent: May 8, 2012

(54) CUTTING DEVICE WITH ACTUATING MECHANSIM

(75) Inventors: Scott D. Gullicks, Apple Valley, MN (US); Gerald E. Mueller, Eagan, MN (US); Joy A. Packard, Hudson, WI (US); Scott D. Pearson, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 11/829,242

(22) Filed: Jul. 27, 2007

(65) Prior Publication Data

US 2008/0040932 A1 Feb. 21, 2008

Related U.S. Application Data

(63) Continuation-in-part of application No. 11/616,996, filed on Dec. 28, 2006, which is a continuation-in-part of application No. 11/408,781, filed on Apr. 21, 2006.

(60) Provisional application No. 60/673,824, filed on Apr. 22, 2005, provisional application No. 60/699,905, filed on Jul. 15, 2005.

(51) Int. Cl.
*B26B 27/00* (2006.01)

(52) U.S. Cl. ..... 30/294; 30/2; 30/280

(58) Field of Classification Search ..... 30/2, 278, 30/280, 286, 289–291, 294, 295, 314, 317; 83/614, 566, 568, 916; D8/98, 102
See application file for complete search history.

(56) References Cited

U.S. PATENT DOCUMENTS

| | | | | |
|---|---|---|---|---|
| 515,094 | A | 2/1894 | Payne | |
| 521,115 | A | 6/1894 | Hoper | |
| 838,852 | A * | 12/1906 | Eckley | 30/287 |
| 1,099,885 | A * | 6/1914 | Peple | 30/294 |
| 1,399,924 | A | 12/1921 | Berthelsen | |
| 1,566,878 | A | 12/1925 | Jones | |
| 2,050,768 | A | 8/1936 | Seymour | |
| 2,274,978 | A | 3/1942 | Currier | |
| 2,294,018 | A * | 8/1942 | Borst | 30/294 |
| 2,329,805 | A | 9/1943 | Wilson, Sr. | |
| 2,388,695 | A | 11/1945 | Kriewaldt | |
| 2,389,648 | A * | 11/1945 | Stafford | 30/151 |

(Continued)

FOREIGN PATENT DOCUMENTS

DE 3614860 A1 11/1987

(Continued)

OTHER PUBLICATIONS

"World's Best Gift Wrap Cutter," New Design Inc., Vernon Hills, IL 60061, brochure, pp. 1-4.

(Continued)

*Primary Examiner* — Edward Landrum
(74) *Attorney, Agent, or Firm* — Kevin W Weber; Lisa P. Fulton

(57) ABSTRACT

A device for cutting media is provided. The device includes a cover having a sidewall extending therefrom; a guide disposed substantially beneath the cover and comprising a blade; an actuating mechanism disposed in at least one of the cover and the guide; and an actuating wall disposed between the cover and the guide. Engagement of the actuating mechanism creates a cutting action between the blade and the actuating wall.

9 Claims, 3 Drawing Sheets

U.S. PATENT DOCUMENTS

| | | | | | |
|---|---|---|---|---|---|
| 2,428,490 | A | * | 10/1947 | Goughnour | 30/131 |
| 2,571,234 | A | | 10/1951 | Guest | |
| 2,597,540 | A | * | 5/1952 | Smith | 30/156 |
| 2,610,399 | A | | 9/1952 | Adams et al. | |
| 2,645,007 | A | | 7/1953 | Alfredsson et al. | |
| 3,028,670 | A | | 4/1960 | Tilly | |
| 3,159,913 | A | * | 12/1964 | Winton | 30/252 |
| 3,230,620 | A | | 1/1966 | McKinley | |
| 3,365,798 | A | | 1/1968 | Cunningham | |
| 3,374,541 | A | * | 3/1968 | Earnest, III et al. | 30/232 |
| 3,613,241 | A | * | 10/1971 | Allen | 30/294 |
| 3,673,687 | A | | 7/1972 | Phillips et al. | |
| D230,007 | S | | 1/1974 | Cramer | |
| 3,815,231 | A | * | 6/1974 | Greenberg | 30/228 |
| 3,824,688 | A | | 7/1974 | Goffe | |
| 3,835,536 | A | | 9/1974 | Marcoux | |
| 3,883,953 | A | | 5/1975 | Saullo et al. | |
| 4,001,934 | A | | 1/1977 | Bell | |
| 4,106,196 | A | | 8/1978 | Smithline | |
| 4,134,206 | A | | 1/1979 | Beermann | |
| D254,243 | S | | 2/1980 | Florian et al. | |
| 4,373,263 | A | | 2/1983 | Ayers | |
| D269,154 | S | | 5/1983 | Freedman et al. | |
| 4,581,823 | A | | 4/1986 | Gilman | |
| D291,651 | S | | 9/1987 | Sieg et al. | |
| 4,831,734 | A | * | 5/1989 | De Ruyter et al. | 30/124 |
| D305,499 | S | | 1/1990 | Walker | |
| 4,980,942 | A | | 1/1991 | Spargo, Sr. | |
| D320,150 | S | | 9/1991 | Huang | |
| 5,046,253 | A | | 9/1991 | Ireland | |
| 5,054,699 | A | | 10/1991 | DeJaynes | |
| 5,072,515 | A | | 12/1991 | Heitz | |
| 323,967 | A | | 2/1992 | Talbot | |
| 5,205,007 | A | * | 4/1993 | Goldstein | 7/135 |
| 5,232,132 | A | | 8/1993 | Broussard et al. | |
| 5,285,575 | A | | 2/1994 | Hirano | |
| 5,400,452 | A | * | 3/1995 | Goldstein | 7/135 |
| 362,168 | A | | 9/1995 | Mancini | |
| 5,480,080 | A | | 1/1996 | Ferguson | |
| 5,564,145 | A | | 10/1996 | Goldstein | |
| 5,638,603 | A | | 6/1997 | Li | |
| 5,662,669 | A | * | 9/1997 | Abidin et al. | 606/167 |
| 5,697,938 | A | * | 12/1997 | Jensen et al. | 606/120 |
| 5,724,738 | A | | 3/1998 | Ballarini | |
| 5,737,842 | A | * | 4/1998 | Freedman | 30/280 |
| 5,758,422 | A | * | 6/1998 | Frank | 30/230 |
| 5,768,787 | A | | 6/1998 | Ireland | |
| 5,809,656 | A | | 9/1998 | Lindberg | |
| 5,896,667 | A | | 4/1999 | Hawkins | |
| 5,964,388 | A | | 10/1999 | Jennings et al. | |
| 5,983,505 | A | | 11/1999 | Gibson | |
| 6,003,181 | A | | 12/1999 | Wenk | |
| D423,318 | S | | 4/2000 | Lacy | |
| D424,397 | S | | 5/2000 | Wiseman | |
| 6,131,223 | A | | 10/2000 | Rehkemper et al. | |
| 6,240,645 | B1 | | 6/2001 | Ozeki | |
| 6,371,844 | B1 | | 4/2002 | Holler | |
| 6,493,945 | B1 | | 12/2002 | DeRosa et al. | |
| 6,578,266 | B2 | | 6/2003 | Chomiak | |
| 6,615,495 | B1 | | 9/2003 | Evens et al. | |
| D481,609 | S | | 11/2003 | Perlmutter et al. | |
| 6,941,664 | B1 | | 9/2005 | Engle et al. | |
| D514,916 | S | | 2/2006 | Craig | |
| 7,003,884 | B2 | | 2/2006 | Perlmutter et al. | |
| D525,852 | S | | 8/2006 | Pearson et al. | |
| D527,603 | S | | 9/2006 | Gullicks et al. | |
| 2003/0213133 | A1 | | 11/2003 | Hanna | |
| 2004/0088868 | A1 | | 5/2004 | Fazio | |
| 2006/0236550 | A1 | | 10/2006 | Gullicks et al. | |
| 2007/0245571 | A1 | | 10/2007 | Pearson | |

FOREIGN PATENT DOCUMENTS

| | | | |
|---|---|---|---|
| DE | 196 54 034 | | 7/1997 |
| DE | 202 14 317 | | 9/2002 |
| EP | 771256 | B1 | 9/1999 |
| FR | 965628 | | 9/1950 |
| JP | 05-318333 | | 12/1993 |
| JP | 10-295953 | | 11/1998 |
| JP | 2915902 | | 4/1999 |
| JP | 2001-62162 | | 3/2001 |
| JP | 2001-198368 | | 7/2001 |
| JP | 2001-259256 | | 9/2001 |
| KR | 20-0240124 | | 7/2001 |
| KR | 20-0243780 | | 8/2001 |
| WO | 95/35190 | | 12/1995 |
| WO | 01/14108 | A1 | 3/2001 |

OTHER PUBLICATIONS

"The Ribbon-Master®" from Group One Limited, [retrieved from the internet Dec. 5, 2005], URL http://www.grouponelimited.com/rib_mast.htm, pp. 1-4.

"The Mini-Master™", from Group One Limited, [retrieved from the internet Dec. 5, 2005], URL http://www.grouponelimited.com/mini_mas.htm, pp. 1-3.

"Film & Sheet Safety Cutters," Martor USA [on line], [retrieved from the internet Apr. 11, 2005], URL <http://www.martorusa.com/s.nl/sc.2/category.8/.f>, pp. 1-4.

"Sniffy (On Card)—43037," Martor USA [on line], [retrieved from the Internet Apr. 7, 2005], URL <http://www.martorusa.com/s.nl/sc.2/category.8/It.A/Id.640/.f>, pp. 1-2 and 1.

"The Amazing Open X®," [on line], [retrieved from the Internet Jun. 20, 2005], URL <http://www.myopenx.com/guarantee.htm>, pp. 1.

* cited by examiner

CUTTING DEVICE WITH ACTUATING MECHANSIM

CROSS-REFERENCE TO RELATED APPLICATION

This application is a continuation-in-part of U.S. Ser. No. 11/616,996 filed Dec. 28, 2006, which is a continuation in part of U.S. Ser. No. 11/408,781 filed Apr. 21, 2006, which claims priority to U.S. Provisional Patent Application No. 60/673824 filed Apr. 24, 2005 and U.S. Provisional Patent Application No. 60/699905 filed Jul. 15, 2005, all of which are hereby incorporated by reference in their entirety.

FIELD OF INVENTION

The present invention pertains to a hand-held, lightweight, and portable device for cutting media. In particular, the device includes an actuating mechanism that can be activated by a user to facilitate the cutting process.

BACKGROUND

There are a variety of tools available today for cutting media such as paper, plastics, cardboard, and the like, the most common tools being scissors and utility knives. Some of the drawback of scissors and utility knives include exposed cutting edges and in some designs, there may be a pointed end that can inadvertently hurt someone if the scissor or utility knife is mishandled.

While scissors and utility knives are commonplace, those skilled in the art have designed new and useful cutting devices. For example, 3M Company sells a Scotch® Paper Cutter for cutting numerous types of media, including, but not limited to, gift-wrapping paper.

There remains a need for new types of cutting devices.

SUMMARY

Some cutting tools may have a difficult time to start a cut from an edge of the media if the media lacks stiffness (e.g., very thin gift wrapping paper that tends to be flimsy to handle), has poor edge condition, or has an edge that is reinforced (e.g., an edge where the paper is folded over itself.) It is desirable to have cutting tools that can readily handle such media while also capable of making intricate cuts such as those involving curves, jagged lines, and sharp corners.

The present invention provides a media cutting device that is capable of handling various media and capable of making intricate cuts.

In one aspect, the present invention pertains to a device for cutting media comprising: a cover having a sidewall extending therefrom; a guide disposed substantially beneath the cover and comprising a blade; an actuating mechanism disposed in at least one of the cover and the guide; and an actuating wall disposed between the cover and the guide.

In another aspect, the present invention pertains to a device for cutting media comprising a blade having a cutting edge; an actuating mechanism comprising means for engaging the actuating mechanism, an actuating wall that upon engagement of the actuating mechanism results in its relative movement parallel to a plane that includes the blade and past at least a portion of the cutting edge of the blade.

As used herein, the term "actuating mechanism" generally means a mechanical system that, when engaged, causes mechanical parts, including an actuating wall, into motion. The term "actuating wall" denotes the portion of the cutting device that, when the actuating mechanism is activated, is in relative movement parallel to a plane that includes the blade and moves past at least a portion of the cutting edge. When media is present in the device such that it lies between the actuating wall and the blade and when the actuating mechanism is engaged, the actuating wall forces or pushes the media onto and past the cutting edge of the blade resulting in the media being cut. The actuating wall has a contact point that touches the media when the mechanism is engaged. Preferably, the actuating wall does not contact the cutting edge of the blade.

The media has two major surfaces, a first surface and an opposite second surface. The "media contact point" of the sidewall describes the general location where the sidewall makes contact with the first major surface of the media while the cutting edge makes contact with the second major surface of the media.

In another aspect, the present invention pertains to a device for cutting media comprising: a blade having a cutting edge; and an actuating mechanism comprising (i) means for engaging the actuating mechanism, and (ii) an actuating wall that upon engagement of the actuating mechanism results in relative movement parallel to a plane that includes the blade and at least a portion of the cutting edge of the blade. In another embodiment, the actuating wall does not contact the cutting edge of the blade when the mechanism is engaged.

BRIEF DESCRIPTION OF THE DRAWINGS

The invention can be further described with reference to the following drawings, wherein.

While the above-identified drawings set forth several embodiments of the invention, other embodiments are also contemplated, as noted in this document. In all cases, this disclosure presents the invention by way of representations and not limitation. Numerous other modifications and embodiments can be devised by one skilled in the art which fall within the scope and spirit of the principals of this invention. The figures are idealized, are not drawn to scale, and are intended merely for illustrative purposes.

DETAILED DESCRIPTION

The cutting devices described herein are capable of performing at least two types of cutting actions: (1) cutting the media by advancing the media relative to the device (i.e., moving the media through the blade in the device or moving the device, with its blade, through the media); and (2) cutting the media without advancing the media relative to the device. The first type of cutting action can be descriptively referred to as a "zipping" type of cutting action and is commonly used to cut media in a substantially straight line or to cut curved lines with a relatively large radius of curvature, e.g., a radius of curvature of greater than about one inch. The second type of cutting action can be described as a "clipping" type of action and is commonly used for intricate cuts. Advantageously, the inventive cutting device is capable of performing a combination of these two types of cutting actions. For example, a sequence of cuts can begin with clipping the media, followed by zipping through it, and returning to clipping it. In an alternative sequence, the cuts begin with zipping, followed by clipping, and if desired returning to zipping. In either cutting sequence, the inventive cutting device will produce a substantially non-jagged cut line, which can be a very desirable feature, especially in applications where clean cut edges are needed. The term "non-jagged line" generally means that a cut from one type of action lies substantially coincident to a cut from the other type of cutting. This feature is also desirable in that if the user is interrupted during the cutting processes, he can resume cutting without the need to realign the blade with the previous cut in the media.

The inventive cutting devices described herein are also capable of holding media in place. That is, once the actuating mechanism of the device is engaged or depressed while media is present in the device, the media is held stationary in the device, e.g., between the blade and the actuating wall until the user disengages the actuating mechanism. Thus, the user can stop cutting midstream, move the media and the device to a new location, and resume cutting.

Figure 1:
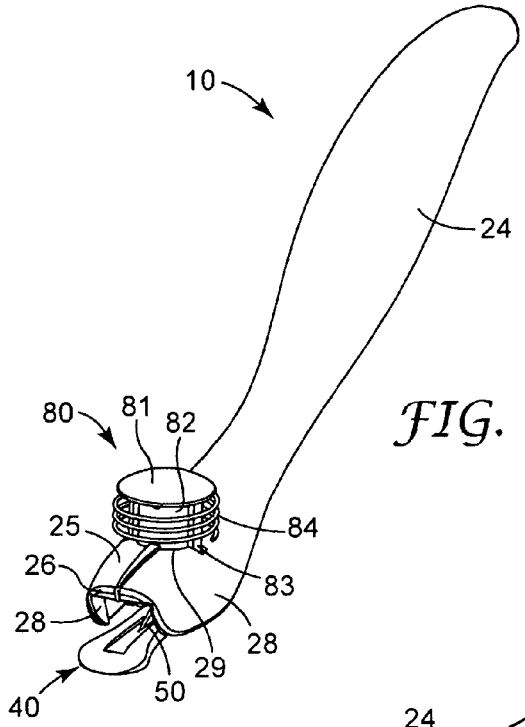
FIG. 1 is a perspective view of one exemplary embodiment of the present invention.
Figure 2:
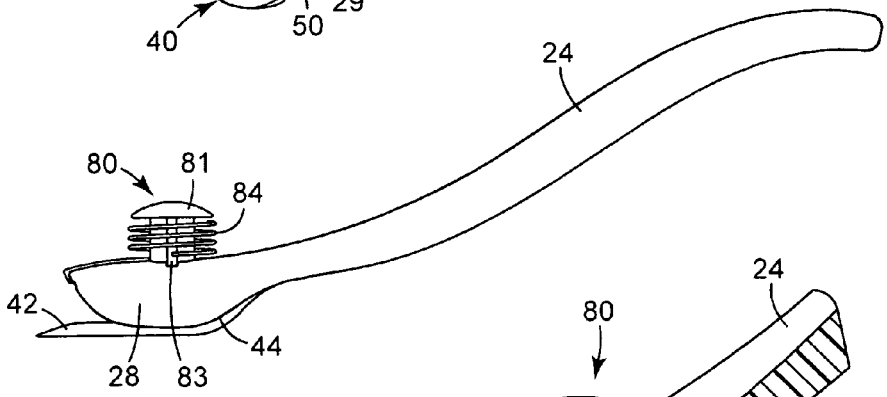
FIG. 2 is a side view of the embodiment of FIG. 1.
Figure 3:
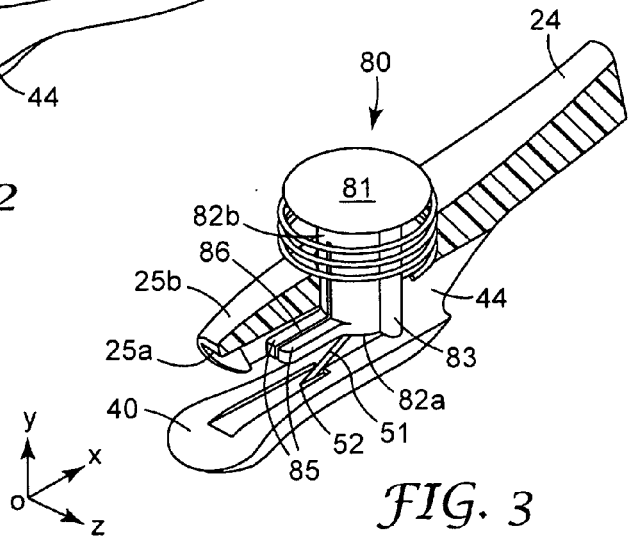
FIG. 3 is a partial cut-away view of the embodiment of FIG. 1.

Turning now to FIGS. 1 to 3, they show several views of a first exemplary media cutting device 10. The cutting device includes an optional handle 24, a cover 25 having sidewalls 28 extending therefrom and a guide 40 disposed substantially beneath the cover. While this figure shows two sidewalls 28 with the guide disposed between the two sidewalls and underneath the cover, it is within the scope of the present invention to use one sidewall, as described in publication US 2006/0236550 A1. A portion of a blade 50 is disposed in the guide. The blade includes a cutting edge 51. The cover has an exposed end 26 and the guide has a free end 42. The cutting device further includes an actuating mechanism 80 disposed, in this particular embodiment, in the cover through an aperture 29 having a continuous perimeter. The aperture has been appropriately sized to accommodate a shaft 82, which is a component of the actuating mechansim. The actuating mechanism also includes a biasing means, in this case, a coil spring 84, wrapped around a first portion of the shaft, an optional contact section 81, and an optional channel 83 disposed laterally along the circumference of the shaft.

The sidewall has a media contact point. The media contact point of the sidewall is disposed away from the trailing edge in the direction of the leading edge. In one embodiment, the media contact point on the sidewall lies between the leading edge and the trailing edge. In another embodiment, the media contact point of the sidewall extends beyond the leading edge of the blade but not beyond bottom surface of the guide.

FIG. 3 shows a partial cut-away view of the embodiment of FIG. 1 along with a Cartesian coordinate system having an origin 0. When the origin coincides with a point where the cutting edge 51 of the blade meets the guide (generally shown as reference number 52). The cutting edge lies in the x-y plane. The cover has an inside surface 25*a* and an outside surface 25*b*, the inside surface being closer to the guide and the blade as compared to the outside surface. The shaft of the actuating mechanism has opposing first end (not labeled but disposed generally underneath the contact section 81) and second end 82*a*. The elongate protrusion 83 extends from the first end to the second end of the shaft. The shaft also includes a first portion 82*b* that is associated with its first end. In general, the first portion of the shaft encompasses that region that extends from the outside surface 25*b* of the cover to the contact section 81. The shaft also includes a second portion (not labeled) that extends from the inside surface 25*a* of the cover to the second end 82*a*. The coil spring is disposed about the first portion of the shaft. Projecting from the second end 82*a* of the shaft are two optional substantially symmetrical extensions 85 with a slit 86 disposed therebetween. This invention, however, can be practiced with one extension. The slit 86 also extends to the second end 82*a* of the shaft thereby creating, in at least a portion of the shaft, two substantially equal halves.

FIGS. 1 to 3 show the device when the actuating mechanism has not been engaged. In such a case, the device is capable of cutting media, such as paper, through a zipping type of cutting action. That is, the user engage the device against the media such that a top surface of the media is in contact with the sidewall of the device and an opposing bottom surface of the media is in contact with the guide, as described in detail in publication US 2006/0236550 A1. The user can then slide the device through the media thereby cutting it with the blade.

In use, typically the device engages an edge of the media. As the device slides further into the media, the cutting edge in combination with the sidewall, particularly the media contact point on the sidewall, deforms the media so that it no longer lies in one continuous plane from one side of the device to the other side of the device. The deformation occurs in the area of the media that is presented to the cutting edge (the "presented area"). In some embodiments, the presented area is the area between the sidewalls and on that portion of the cutting edge that makes contact with the media. In the embodiment where only one side wall is present, the presented area is the region between the sidewall and the cutting edge that has made contact with the media. The magnitude of the deformation is determined by factors such as, e.g., the weight, stiffness, and thickness of the media, and the location of the media contact point with respect to the trailing edge. There may be other factors that determine the magnitude of the deformation.

In one embodiment, during the cutting process, the media does not come into contact with inside surface of the cover. During the cutting process, the sidewall may exert various frictional forces on the media. There is at least one frictional force that opposes the media from riding up the cutting edge.

When a clipping type of cutting is desired, the user engages the actuating mechanism by pressing on the contact region 81, causing the shaft 82 to move in a direction that is substantially parallel to the y-axis. This motion imposes a compressive stress on the spring, decreases the length of the first portion 82*b* of the shaft, and simultaneously increases the length of the second portion of the shaft, as compared to when the actuating mechanism is not engaged. If the optional extension 85 is present, it acts as the actuating wall moving in the same direction as the shaft. The slit 86 allows the extensions 85 to straddle the cutting edge of the blade. When media lays between the cutting edge and the actuating wall, engaging the actuating mechanism forces at least a portion of the actuating wall to move past at least a portion of the cutting edge, thereby clipping the media. When the optional extension 85 is not used, the second end 82*a* of the shaft acts as the actuating wall. When the user disengages the actuating mechanism, the compressive force on the spring is released and the shaft returns to its unengaged position. Repeated engagement and disengagement of the actuating mechanism cuts the media in a clipping type action. In this way, the user can make intricate non-linear cuts, such as, e.g., curves, sharp corners, jagged lines, and the like. After the media has been clipped, if the user wants a straight line cut, (s)he simply continues cutting by sliding the device so that blade cuts the media by the zipping action. The zipping type of cut can occur with the actuating mechanism engaged or disengaged.

Figure 4:
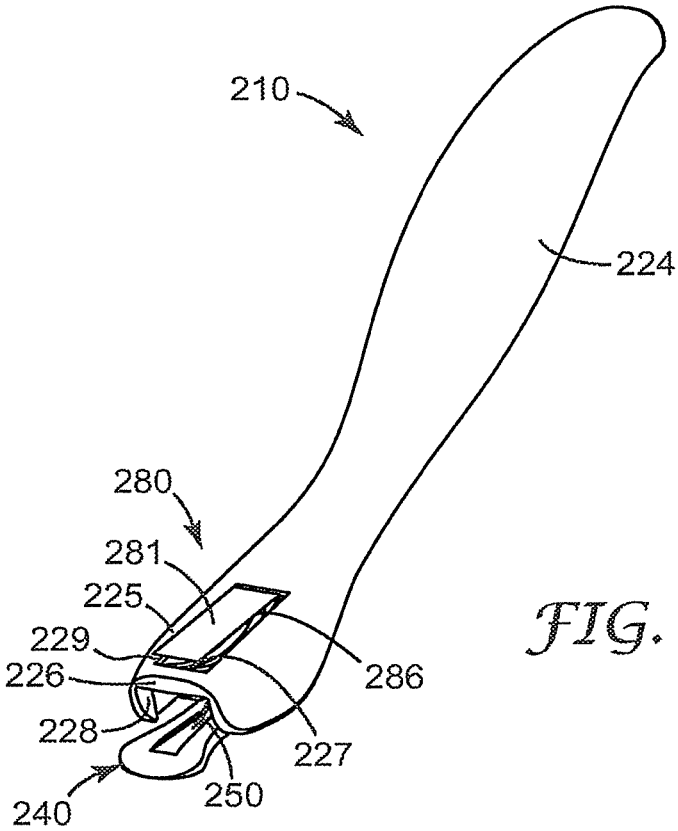
FIG. 4 is a perspective view of another exemplary embodiment of the present invention.
Figure 5:
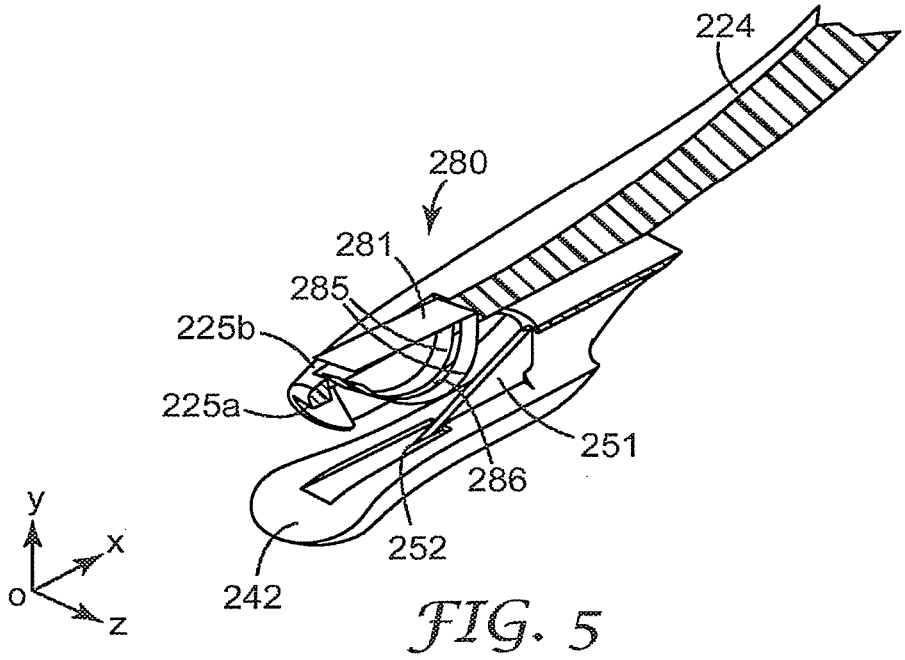
FIG. 5 is a partial cut-away view of the embodiment of FIG. 4.

FIGS. 4 and 5 show various views of a second exemplary embodiment of the present invention. A cutting device 210 includes an optional handle 224, a cover 225 having sidewalls 228 extending therefrom and a guide 240 having a free end 242 disposed substantially beneath the cover. The cover has an inside surface 225*a*, an outside surface 225*b*, and an exposed end 226. The cover includes an aperture 229 having a continuous perimeter that is appropriately sized to accommodate an actuating mechanism 280, which is attached to the cover at attachment point 227. The actuating mechanism includes two substantially symmetrical actuating wall 285 having a slit 286 disposed therebetween. The actuating wall has a curved section that lies almost entirely within the aperture 229. The actuating wall further includes a substantially straight contact region 281, which is that portion of the actuating mechanism where the user would depress or engage to the actuating mechanism. While the contact region is designed to as to substantially cover the aperture 229 so as to minimize the user's exposure to the blade, other designs can be used as well. As in the first embodiment, the invention is operable with one actuating wall.

FIGS. 4 and 5 show the device when the actuating mechanism has not been engaged where the device is capable of cutting media through a zipping type of cutting action, as described above in the first embodiment. For discussion purposes, a Cartesian coordinate system is provided having an origin O. When the origin coincides with reference point 252, which is a location where the cutting edge 251 of the blade meets the guide, the cutting edge lies in the x-y plane.

When a clipping-type of cutting action is desired, the user engages the actuating mechanism by pushing on the contact region 281 forcing or pushing at least a portion of the actuating wall past at least a portion of the cutting edge thereby cutting the media that is present therebetween. The slit allows the two actuating walls to clear and straddle the cutting edge. When the user releases the contact region, the actuating wall moves back to its initial position. Repeated engagement of the actuating mechanism by pushing and releasing on the contact region cuts the media in a clipping type of cutting action.

Figure 6:
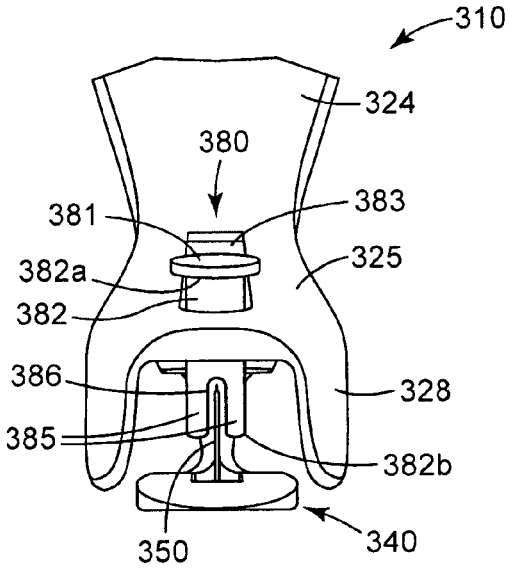
FIG. 6 is a front view of yet another exemplary embodiment of the present invention.

FIG. 6 shows a front end view of a third exemplary embodiment of the present invention. Cutting device 310 of the present invention includes optional handle 324, a cover 325 having sidewalls 328 extending therefrom, and a guide 340 disposed substantially beneath or under the cover. The cover has an exposed end 326 and the guide has a free end 342. A portion of a blade 350 is disposed in the guide. The cutting device further includes an actuating mechanism 380 disposed in the cover through a channel 383 or a track appropriately sized to accommodate and to allow movement of a slideable pin 382. The channel has a defined length starting from near the exposed end of the cover and spanning towards the handle. The channel has a width that is sized to accommodate the diameter of the pin. The pin has opposing first and second ends, 382*a* and 382*b*, respectively. The pin may optionally include a collar to help it stay within and glide along the channel. Optionally, a contact region 381 is disposed on the first end of the pin. On the second end of the pin, an upside down U-shaped feature forms an actuating wall 385. Again, as with the two previous embodiments, only one side or leg of the U-shaped actuating wall is needed for the practice of the present invention. When the user engages the actuating device by, e.g., moving the slideable pin along the channel, at some point, the actuating wall straddles a portion of the blade and its cutting edge. When media is present between the cutting edge of the blade and the actuating wall, engaging the actuating mechanism forces or pushes the media against a cutting edge of the blade thereby cutting it. Thus, repeated sliding of the actuating mechanism back and forth along the channel cuts the media.

Figure 7:
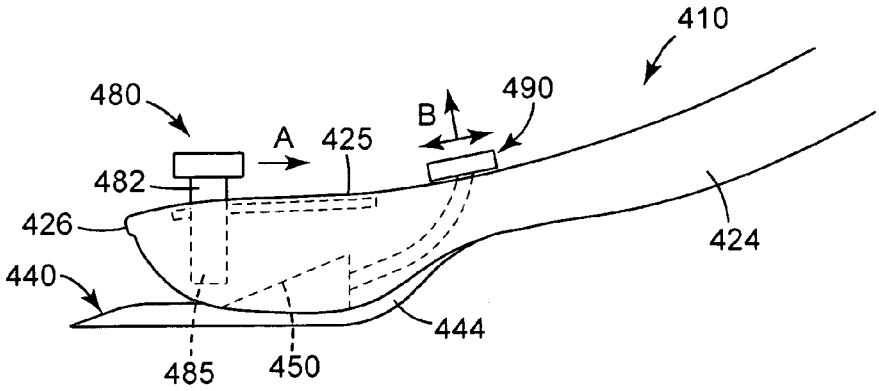
FIG. 7 is a schematic side view of yet another exemplary embodiment of the present invention with portions of the actuating mechanism shown in phantom.

FIG. 7 shows a schematic side view of a fourth exemplary embodiment of the present invention. A cutting device 410 includes an optional handle 424, a cover 425 having an exposed end 426, a guide 440 disposed substantially beneath the cover, and a blade 450 that is optionally disposed in a portion of the guide. This particular embodiment includes a first actuating mechanism 480 that is similar to the actuating mechanism 380 of FIG. 6 in that a slideable pin 482, with actuating walls therein, is used. Arrow A schematically depicts how the user can engage the actuating mechanism, i.e., by advancing it towards the blade. The cutting device may also include a second actuating mechanism 490. Arrows B schematically depicts how the user can engage the second actuating mechanism, i.e., by advancing the blade and or the guide toward the actuating wall of the first actuating mechanism. While this figure shows the second actuating mechanism accessible near the handle, it is within the scope of the present invention to have the second actuating mechanism accessible at an attached end 444 of the guide. Thus, the inventive device requires only that there is relative movement between the cutting edge of the blade and the actuating wall.

In yet another exemplary embodiment, a cutting device of the present invention includes an actuating mechanism, which when engaged, creates an actuating wall. This embodiment differs from the first four embodiments because they have at least one preformed actuating wall. In contrast, in the embodiment discussed here, the actuating mechanism can be made of a deformable polymeric material, such as foam, that is disposed in the cover. To engage the actuating mechanism, the user presses on the foam with her finger with sufficient pressure to force a portion of the foam to extend beyond the cutting edge of the blade towards the guide. In other words, for ease of discussion, with reference to FIG. 5, if the actuating mechanism therein was replaced with the deformable foam, upon pressing down on the foam (i.e., in the y-direction), a portion of the foam would extend beyond the cutting edge of the blade. It is upon the pressing of the foam with sufficient force that gives rise to the actuating wall in the foam. Upon releasing the pressure on the foam, the actuating wall disappears. When media is present in the cutting device between the cutting edge of the blade and the foam, the pressing on the foam will force the media against the cutting of blade thereby cutting it. The foam, or any deformable polymeric material, is chosen with respect to the blade material such that the cutting edge of the blade will not cut the foam.

The actuating mechanism of the present invention can be made from a variety of materials, including but not limited to, metals, polymers, ceramics, wood, and combinations thereof. For example, the actuating mechanism of the embodiment of FIGS. 4 and 5 can be made from a metal material that allows the actuating wall to pivot when the actuating mechanism is engaged. Furthermore, while the actuating mechanism in the above described embodiments are generally disposed in or is part of the cover and or part of the guide, the mechanism can also be disposed in the sidewall of the device.

Finally, it should be noted that the inventive device differs from scissors in several aspects. For example, scissors include two blades attached at a pivot point. Typically a first blade makes contact with a second blade to cut the media. The inventive cutting device uses a single cutting edge and when engaged, an actuating mechanism that does not make contact with but merely moves past the cutting edge of the blade. Furthermore, the inventive device has no similar pivot point as that of scissors.

What is claimed is:

1. A device for cutting media comprising:

a cover having a sidewall extending therefrom and the cover having a top surface, an exposed end, an inner surface opposite the top surface, and an aperture having a continuous perimeter extending through the top surface of the cover;

a guide disposed from the inner surface of the cover and comprising a blade and a guide surface facing the inner surface, wherein:

the guide surface is spaced from and faces the inner surface to define a gap open at the exposed end for receiving media to be cut, the blade forms a cutting edge having a length between opposing leading and trailing regions, the length being greater than a width of the cutting edge, and the leading region proximate to and the trailing region distal to the exposed end, and the cutting edge projects from the guide surface and across a portion of the gap, with the leading region being located at the guide surface and the trailing region being transversely spaced from the guide surface in a direction of the inner surface such that a linear distance between the cutting edge and the guide surface in the direction of the inner surface increases from the leading region to the trailing region with reference to the cutting edge, the sidewall has a media contact point that is disposed away from the trailing edge in the direction of the leading edge;

an actuating mechanism disposed in the aperture in the cover, and wherein one end of the actuating mechanism forms a contact region at the top surface of the cover; and an actuating wall disposed between the cover and the guide;

wherein upon engagement of the actuating mechanism, the actuating wall moves substantially parallel to the y-axis-when the origin of a Cartesian coordinate system coincides with the leading edge of the cutting edge and the x-z plane lies substantially coplanar with the top surface of the guide; and wherein the device is configured such that as the device slides into media during use, the cutting edge and the media contact point on the sidewall deform the media in the area of the media that is presented to the cutting edge.

2. The device of claim 1 further comprising a handle extending from a rear end of the cover and a rear end of the guide.

3. The device of claim 1, wherein the actuating wall includes opposing first and second ends, the first end proximate to and the second end distal to the exposed end of the cover, and wherein the aperture is sized for the actuating wall.

4. The device of claim 3, wherein the actuating wall includes a slit creating two arms that straddle the blade when the actuating mechanism is in use.

5. The device of claim 4, wherein each of the arms is flexible and includes a curved portion disposed proximate to the blade when the actuating mechanism engaged.

6. The device of claim 1, wherein the actuating mechanism is made from a material selected from the group consisting of metals, polymers, ceramics, wood, and combinations thereof.

7. A method of cutting media comprising the steps of:

providing a cutting device of claim 1;

bringing the media and the device into contact such that the media is disposed between the cover and the guide; and engaging the actuating mechanism to clip the media.

8. The method of claim 7, wherein after the media has been clipped, the method further includes the step of cutting the media by a zipping-type cutting action.

9. The method of claim 8, wherein the clipping and zipping cutting steps are repeated.

* * * * *